US010858900B2

(12) United States Patent
Haugland et al.

(10) Patent No.: US 10,858,900 B2
(45) Date of Patent: Dec. 8, 2020

(54) DOWNHOLE DEBRIS-COLLECTING TOOL HAVING AN IMPROVED VALVE

(71) Applicant: Altus Intervention (Technologies) AS, Norway (NO)

(72) Inventors: Lasse Haugland, Bryne (NO); Espen Osaland, Sandnes (NO)

(73) Assignee: Altus Intervention (Technologies) AS, Stavanger (NO)

( * ) Notice: Subject to any disclaimer, the term of this patent is extended or adjusted under 35 U.S.C. 154(b) by 156 days.

(21) Appl. No.: 16/079,630

(22) PCT Filed: Feb. 21, 2017

(86) PCT No.: PCT/NO2017/050045
§ 371 (c)(1),
(2) Date: Aug. 24, 2018

(87) PCT Pub. No.: WO2017/146587
PCT Pub. Date: Aug. 31, 2017

(65) Prior Publication Data

US 2019/0055802 A1 Feb. 21, 2019

(30) Foreign Application Priority Data

Feb. 26, 2016 (NO) ..... 20160326

(51) Int. Cl.
*E21B 27/00* (2006.01)
*E21B 27/04* (2006.01)
(Continued)

(52) U.S. Cl.
CPC ..... *E21B 27/04* (2013.01); *E21B 11/04* (2020.05); *E21B 27/00* (2013.01); *E21B 31/08* (2020.05); *E21B 34/06* (2013.01); *E21B 37/00* (2013.01)

(58) Field of Classification Search
CPC ..... E21B 34/06; E21B 37/00; E21B 27/04; E21B 27/00; E21B 11/04; E21B 31/08
See application file for complete search history.

(56) References Cited

U.S. PATENT DOCUMENTS 4,505,341 A 3/1985 Moody et al.
5,251,701 A 10/1993 Williams et al.
(Continued)

FOREIGN PATENT DOCUMENTS

WO 03036020 A1 5/2003

*Primary Examiner* — George S Gray
(74) *Attorney, Agent, or Firm* — Gable Gotwals

(57) ABSTRACT

The downhole tool comprises: (i) a housing connected with a collection chamber for receiving debris, the housing having an opening for collecting the debris from the petroleum well, the opening in fluid communication with the collection chamber through the housing; (ii) a rotatable shaft with transport blades arranged within the housing and extending from the opening to the collection chamber, the rotatable shaft configured for transporting debris from the opening to the collection chamber in operational use; (iii) an annular area defined between the rotatable shaft and an inner wall of the housing and (iv) a valve configured for keeping debris in the collection chamber. The valve is located within the housing between the opening and the collection chamber. The valve comprises a seal member with a movable part mounted in the annular area and around the rotatable shaft. The valve is opened when the movable part moves in direction of the collection chamber and is configured such that the movable part of the seal member is only movable in the direction towards the collection chamber when closed. The downhole tool provides a valve, which is easily opened, requiring a very small force, while providing a very good sealing effect when the seal member is closed.

11 Claims, 8 Drawing Sheets

Figure 1A:
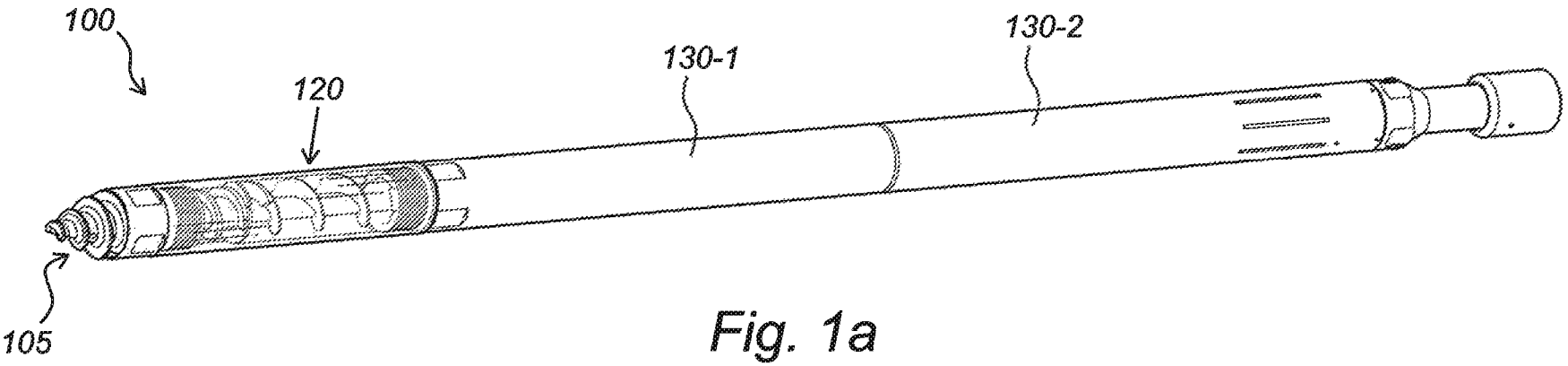

(51) Int. Cl.

| | |
|---|---|
| ***E21B 34/06*** | (2006.01) |
| ***E21B 37/00*** | (2006.01) |
| ***E21B 11/04*** | (2006.01) |
| ***E21B 31/08*** | (2006.01) |

(56) References Cited

U.S. PATENT DOCUMENTS

| | | | | |
|---|---|---|---|---|
| 2008/0023033 | A1 | 1/2008 | Potter | |
| 2012/0118571 | A1* | 5/2012 | Zhou | E21B 27/00 166/301 |
| 2017/0009545 | A1* | 1/2017 | Haugland | E21B 27/00 |
| 2018/0073317 | A1* | 3/2018 | Haugland | E21B 27/04 |
| 2019/0128082 | A2* | 5/2019 | Haugland | E21B 27/04 |

* cited by examiner 100
110ah
110a
105
120
130-1, 130-2

100
105
125
127
127
110b1
110b2
110b
110a
110

DOWNHOLE DEBRIS-COLLECTING TOOL HAVING AN IMPROVED VALVE

CROSS-REFERENCE TO RELATED APPLICATIONS

This United States application is the National Phase of PCT Application No. PCT/NO2017/050045 filed 21 Feb. 2017, which claims priority to Norwegian Patent Application No. 20160326 filed 26 Feb. 2016, each of which is incorporated herein by reference.

FIELD OF THE INVENTION

The invention relates to a downhole tool for collecting debris in a petroleum well. The invention further relates to a seal member for use in such tool.

BACKGROUND OF THE INVENTION

Debris-collecting tools of the kind of the invention are generally used in a casing or tubing in a well. Such tools typically comprise an electric engine-based collection system. An example of such tool typically comprises transport blades on a rotatable shaft, which extends through a collection chamber, a filter section for particle separation, a front part with an input screw and valve. Such downhole tool is known from patent publication WO03/036020A1.

Pollution in a petroleum well typically consists of different materials and often matter with a binding effect. Such material typically collects in the collection chamber and does not fall out even if the debris-collecting tool is pulled out of the well. The collected material must in such cases be scraped out or washed out from the collection chamber. In other cases the polluted material does not comprise any binding material, for example when it concerns silt and sand. These materials are collected in a similar manner in the collection chamber, but have a volatile character and will leak out of the system when the debris-collecting tool is pulled up from a horizontal to a vertical well section. Wherever the word "debris" is used in this description it is intended to include debris, sand, silt, salt, and other volatile components that may be collected from a petroleum well.

In order to keep the volatile consistence materials inside the collection chamber a valve is needed in the lower part of the debris-collecting tool. It is very challenging to collect large amounts of debris with electro mechanical equipment. Such equipment generally has limited torque, because of the fact these tools are supplied via a cable from the surface. Expressed differently, the amount of electrical power that can be fed through the cable is limited and thereby the amount of available torque is limited. Thus, the amount of material that can be collected in one go depends on the force that may be supplied and on how optimal the tool has been designed. The amount of force that is available is therefore desired to be used to the best extent possible, such that larger amounts of material can be taken out of the well in one run. Since it is often not known upfront which consistence the pollution has, and if the pollution shifts in consistence further down the well, is it normal to use a valve as a rule.

Traditional valves in such system are actually quite effective as it comes down to close of the collection chamber. However, these valves require a lot of force in order to be operated. They require a lot of force, because the pollution has to be pressed against the valve to open it and then to be pushed beyond the constriction, which the valve actually forms itself. There is no mechanical transport, which helps to feed the pollution through the valve and valve seat. Thus, large amounts of energy are consumed while pushing the debris through the traditional valve systems.

SUMMARY OF THE INVENTION

The invention has for its object to remedy or to reduce at least one of the drawbacks of the prior art, or at least provide a useful alternative to prior art.

The object is achieved through features, which are specified in the description below and in the claims that follow.

The invention is defined by the independent patent claims. The dependent claims define advantageous embodiments of the invention.

In a first aspect the invention relates more particularly to a downhole tool for collecting debris in a petroleum well. The downhole tool comprises:

- a housing connected with a collection chamber for receiving debris, the housing having an opening for collecting the debris from the petroleum well, the opening being in fluid communication with the collection chamber through the housing;
- a rotatable shaft with transport blades arranged within the housing and extending from the opening to the collection chamber, the rotatable shaft being configured for transporting the debris from the opening to the collection chamber in operational use;
- an annular area defined between the rotatable shaft and an inner wall of the housing, and
- a valve configured for keeping the debris in the collection chamber. The valve is located within the housing between the opening and the collection chamber. The valve further comprises a seal member with a movable part being mounted in the annular area and around the rotatable shaft, wherein the valve is opened when the movable part moves in direction of the collection chamber, and wherein the valve is configured such that the movable part of the seal member is only movable in the direction towards the collection chamber when closed.

The effects of the combination of the features of the invention are as follows. The valve in the downhole tool substantially seals the annular area between the shaft and the inner wall of the collection chamber. The valve opens when debris is collected by the tool and is moved in the direction of the collection chamber and subsequently pushes the movable part in the direction of the collection chamber thereby opening the valve. The invention provides for an efficient integration of a valve in the annular portion of the rotatable shaft. In fact it is this structural arrangement of the seal member, which causes it to be very conveniently integrated with the rotatable shaft, while at the same time ensuring that the seal member is very easily opened when debris is being collected by the transport blades of the rotating shaft and transported to the valve. As soon as the debris hits the valve it will now be very easy to open and be held open by the debris. As soon as the rotatable axis stops rotating the valve closes and the volatile debris, which is collected in the collection chamber will simply push the valve to its closed (and sealing) position. In other words, the downhole tool of the invention provides a valve, which is easily opened, requiring a small force, while at the same time providing a very good sealing effect when the seal member is closed.

In an embodiment of the downhole tool in accordance with the invention the seal member is configured for being substantially static either with respect to the rotatable shaft or with respect to the housing when valve is closed while the rotatable shaft is rotating in operational use of the downhole tool. The advantage of this embodiment is that the sealing effect is significantly improved when the seal member does not move relative to one of said rotatable shaft or said housing (compared to the situation where it would move relative to both parts).

In an embodiment of the downhole tool in accordance with the invention the seal member is mounted around and fixed to the rotatable shaft such that it may rotate together with the rotatable shaft and relative to the housing in operational use of the downhole tool. This embodiment constitutes a first main variant of the previously discussed embodiment for providing said static behaviour between the seal member and the rotatable shaft. Consequently, the seal member will rotate relative to the housing, when the rotatable shaft rotates.

In an embodiment of the downhole tool in accordance with the invention the seal member is mounted around the rotatable shaft such that it may rotate relative to the rotatable shaft while being substantially static with respect to the housing even when the rotatable shaft is rotating in operational use of the downhole tool. This embodiment constitutes a second main variant of the earlier discussed embodiment for providing said static behaviour between the seal member and the housing. Consequently, the seal member will rotate relative to the rotatable shaft, when the rotatable shaft rotates.

In an embodiment of the downhole tool in accordance with the invention the valve comprises a contact surface for the movable part to seal against when closed. This embodiment is advantageous, because the sealing effect of the movable part in the first state is significantly increased by the contact surface.

In an embodiment of the downhole tool in accordance with the invention the rotatable shaft comprises an edge for forming the contact surface. The rotatable shaft forms one boundary of the annular area inside the housing. Therefore, the shaft may be conveniently and easily provided with an edge for forming the contact surface, ensuring a proper sealing effect on the inner boundary of the seal member.

In an embodiment of the downhole tool in accordance with the invention the inner wall of the housing comprises a further edge for forming the contact surface. The housing forms another boundary of the annular area inside the housing. Therefore, the housing may be conveniently and easily provided with a further edge for forming the contact surface, ensuring a proper sealing effect on the outer boundary of the seal member.

In an embodiment of the downhole tool in accordance with the invention the housing has a tubular shape. Tubular shaped housings are as such common in downhole tool, yet this particular shape has advantageous effects on the invention and is therefore separately claimed. This will be further explained with reference to further embodiments.

In an embodiment of the downhole tool in accordance with the invention the rotatable shaft and the collection chamber are oriented relative to each other in a concentric manner. This embodiment is facilitated by the previously discussed embodiment with the housing having a tubular shape. The tubular shape and concentric placement facilitates the fact that the downhole tool has a rotatable shaft.

In an embodiment of the downhole tool in accordance with the invention the seal member comprises a ring-shaped element for substantially closing the annular area in the first state. Building further onto the previously discussed embodiment, this embodiment comprises a ring-shaped element, which conveniently closes the annular area.

In an embodiment of the downhole tool in accordance with the invention the seal member comprises a ring-shaped inner mounting ring for mounted to the rotatable shaft, wherein the movable part is connected with the ring-shaped inner mounting ring. This embodiment provides a convenient way of fixing the movable member to the rotatable shaft. The ring-shaped inner mounting ring may be fixed to the rotatable shaft (for instance using a screw) or it may be mounted such that it can rotate relative to the rotatable shaft, depending on which variant of the invention is build.

The ring-shaped inner mounting ring and the movable member may be moulded together or they may be assembled together using the eyelet principle.

In an embodiment of the downhole tool in accordance with the invention the movable part is configured as a pivotably mounted or bendable curved flap, which extends within the annular area along at least part of the circumference of the seal member. This configuration particularly matches the characteristics of the rotatable axis with transports blades, which may typically be a transport screw. In this embodiment the valve opens by bending (in the direction of the collection chamber) of the movable member around the part of the circumference of the rotatable axis.

In an embodiment of the downhole tool in accordance with the invention the movable part is configured as a ring-shaped disk substantially covering the annular area. In this embodiment the valve opens by bending (in the direction of the collection chamber) of the movable member around the whole circumference of the rotatable axis.

In an embodiment of the downhole tool in accordance with the invention the seal member has been made from flexible material, such as rubber, plastic, or other elastic or woven materials. This embodiment provides for a very convenient solution. First of all, this embodiment has a positive effect on the force, which is required to open the valve, i.e. this force reduces significantly. Second, this embodiment facilitates quick and cheap replacement of the seal member.

In an embodiment of the downhole tool in accordance with the invention the seal member has been cut for defining the movable part. This embodiment implies that the seal member with the movable part is formed from one piece, which results in a cheaper solution in particular when made from flexible materials such as rubber.

In a further variant of the last-mentioned embodiment of the downhole tool in accordance with the invention the seal member has been cut by water cutting. Water cutting forms a very convenient technique for cutting said seal member and defining said movable part.

In an embodiment of the downhole tool in accordance with the invention the seal member comprises a plurality of further movable parts similar to the movable part, wherein said plurality of further movable parts is distributed along the circumference of the seal member. This embodiment forms an alternative to the embodiment where there is only one (large) movable part. More details will be given in the detailed description of the embodiments.

In an embodiment of the downhole tool in accordance with the invention the valve further comprises a further housing comprising a further seal member similar to housing and the seal member and being displaced from the seal member and being mounted in the annular area and around the rotatable shaft within the further housing. Cascading a series of valves in accordance with the invention as in this embodiment provides for a better sealing effect. There may be a series of collection chambers, each chamber having its own single valve at an input side thereof in accordance with the invention, or the (or each) housing is provided with a series of valves for providing a better sealing effect.

In an embodiment of the downhole tool in accordance with the invention the rotatable shaft extends through the collection chamber. Even though it is not essential that the collection chamber is provided with a rotatable shaft (with or without blades) this feature does constitute a convenient embodiment, because an (electric) motor for driving the rotatable shaft may then be conveniently provides on the other side of the collection chamber.

In an embodiment of the downhole tool in accordance with the invention the part of the shaft located within collection chamber also comprises transport blades. The provision of transport blades on the shaft within the collection chamber facilitates the collection of more debris as the transport blades then press the debris deeper into the collection chamber. It is specific for this embodiment that movable part of the sealing element of the invention will conveniently align with the blades of the transport blades inside the collection chamber when collecting debris, which thus effectively prevents the movable part from being ripped off or moved beyond its intended reach.

An embodiment of the downhole tool in accordance with the invention further comprises a plurality of collection chambers for collecting debris. The last chamber of the chain may comprise a filter section.

In a variant of last-mentioned embodiment of the downhole tool in accordance with the invention each collection chamber is provided with a respective valve at its input side having a respective seal member in accordance with the invention. This embodiment is advantageous for collecting debris, which is very volatile as it provides for better sealing.

In a second aspect the invention relates to the seal member for use in the downhole tool in accordance with the invention. As will be understood, the seal element of the downhole tool of the invention will be subject to wear, such that it will need to be replaced after some runs inside the petroleum well. The seal member in accordance with the invention may therefore be commercially made available as an intermediate product to be used in the downhole tool of the invention. The inventors and applicant are therefore entitled to a claim directed to this entity.

In a third aspect the invention relates to a method of manufacturing the seal member in accordance with the invention, wherein the method comprises steps of: i) providing a layer of flexible matter, such as rubber, and ii) cutting said layer to form the seal member and to define the movable member within the seal member. Even though the invention is not limited to a seal member that is manufactured according to a specific manufacturing process, still this embodiment of such method is considered an advantageous embodiment providing a cheap and effective.

In an embodiment of the method in accordance with the invention the step of cutting is carried out with a water-cutting technique.

BRIEF INTRODUCTION OF THE DRAWINGS

Figures 1B, 1C:
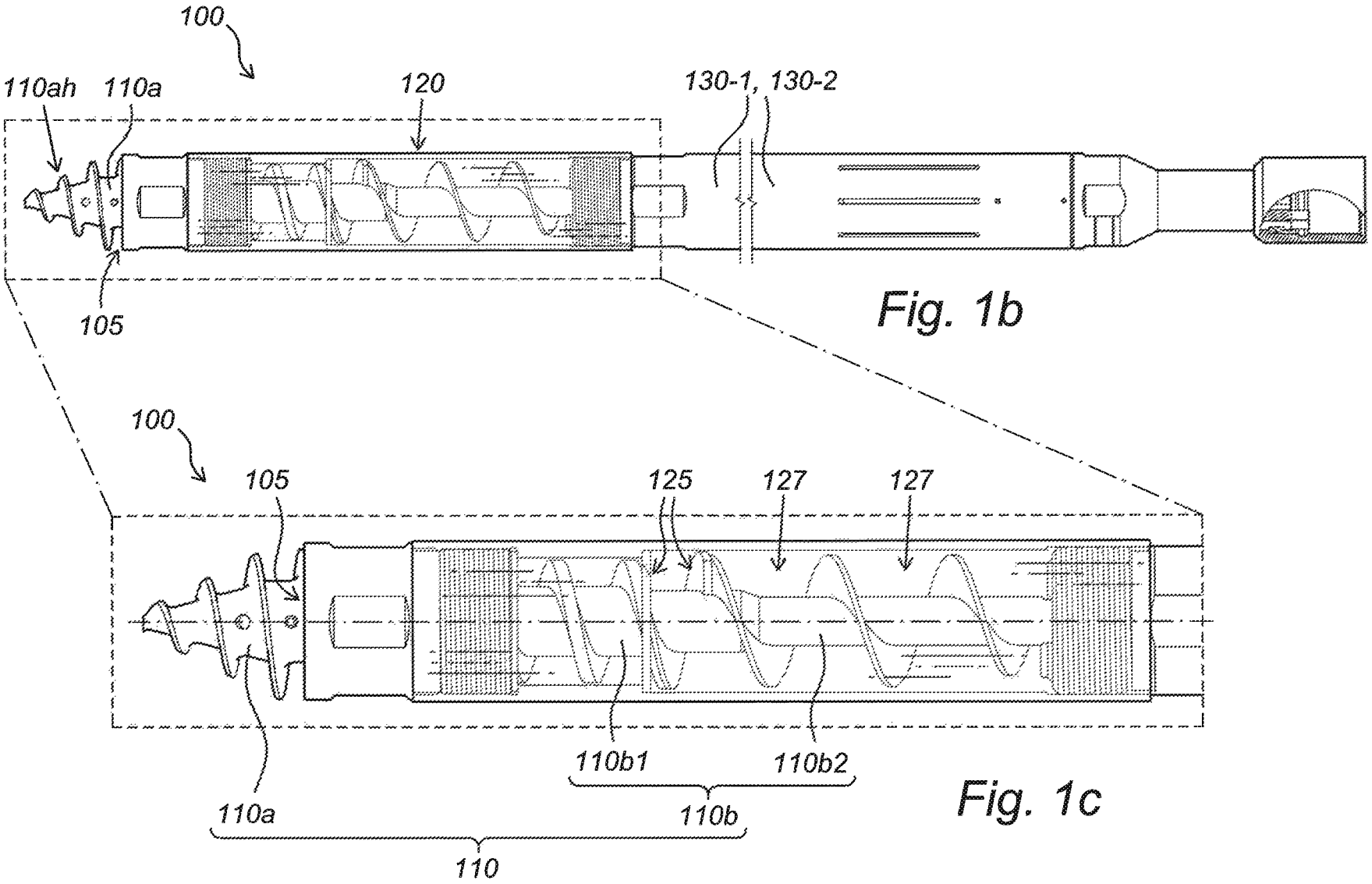

In the following is described examples of preferred embodiments illustrated in the accompanying drawings, wherein:

FIG. 1*a* shows a downhole tool in accordance with a first embodiment of the invention;

FIG. 1*b* shows an enlarged view of the downhole tool of FIG. 1*a;*

FIG. 1*c* shows an enlarged view of FIG. 1*b;*

Figure 2B:
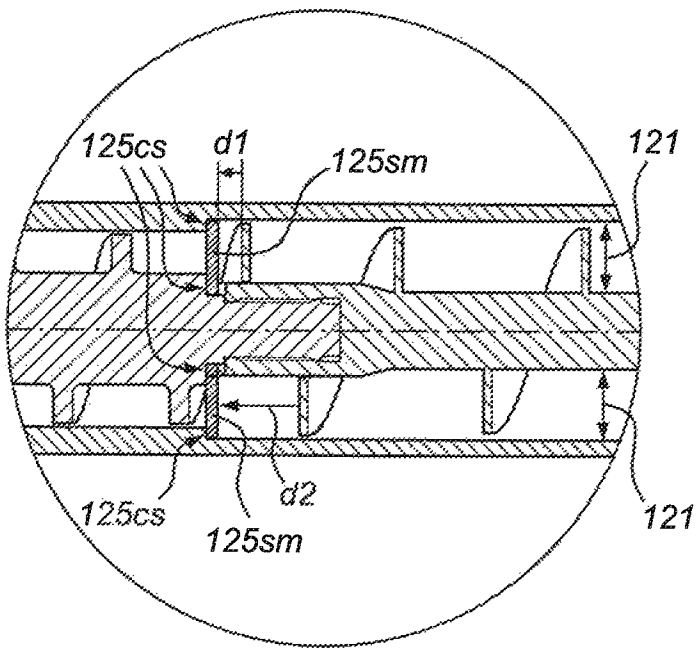
Figure 2A:
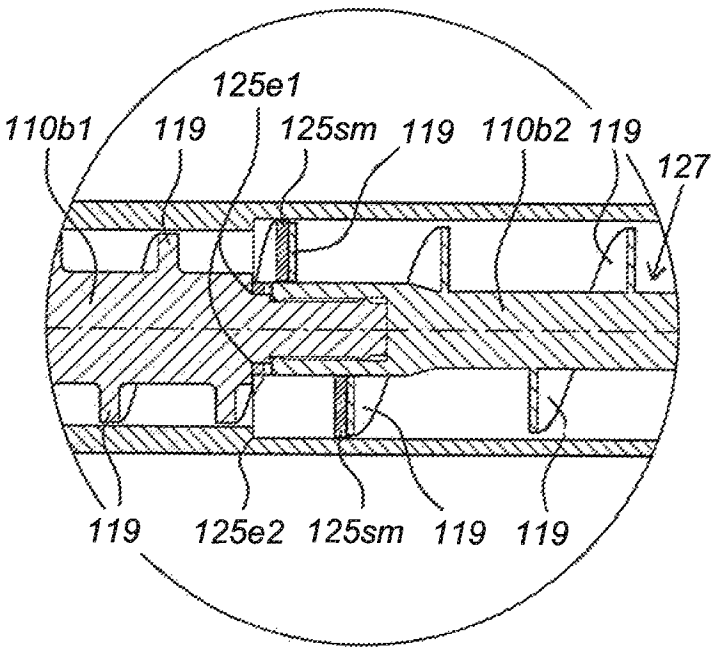
Figure 3A:
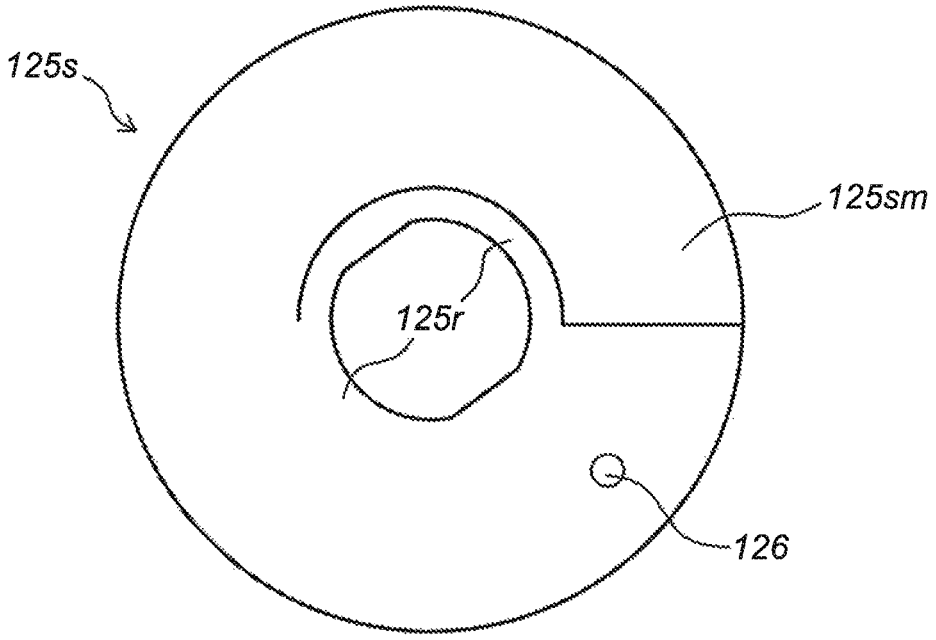
Figure 3B:
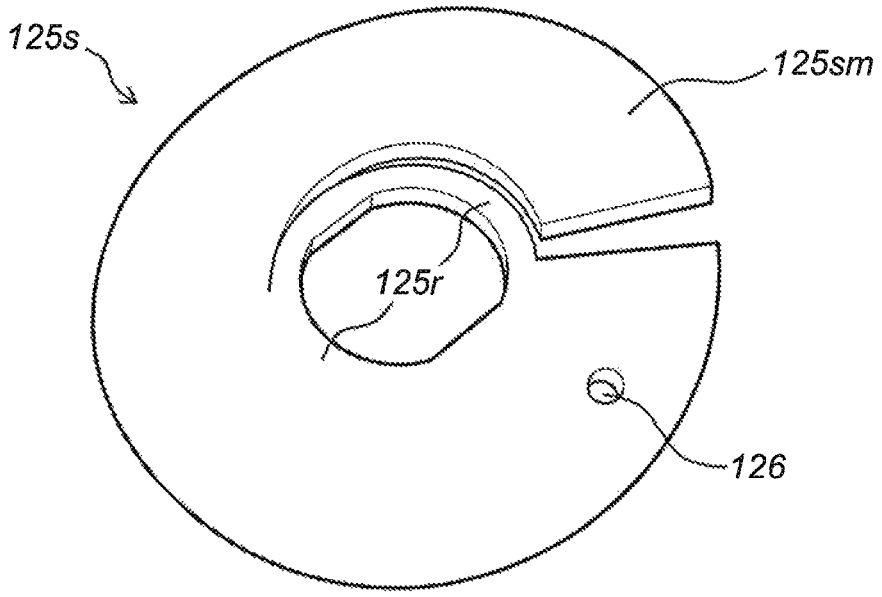
Figure 5:
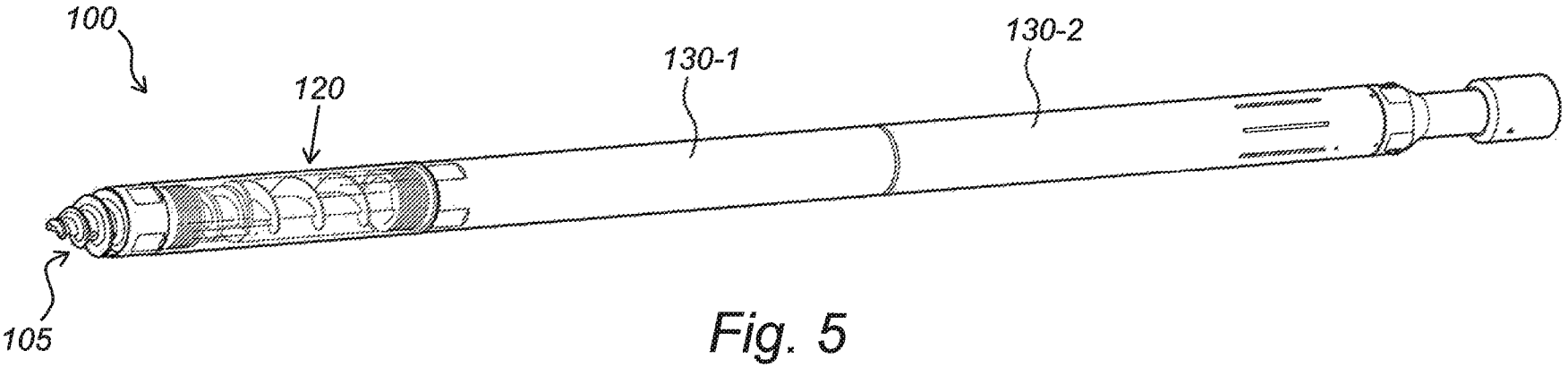
Figure 6B:
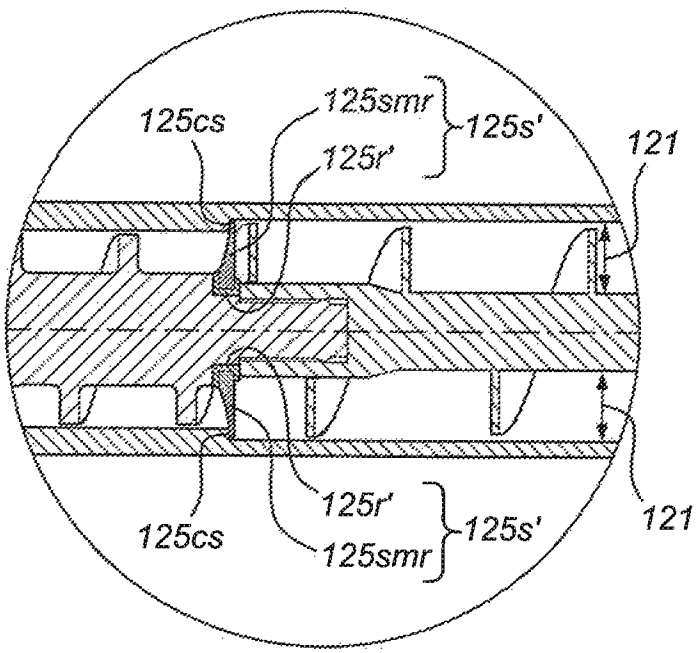
Figure 6A:
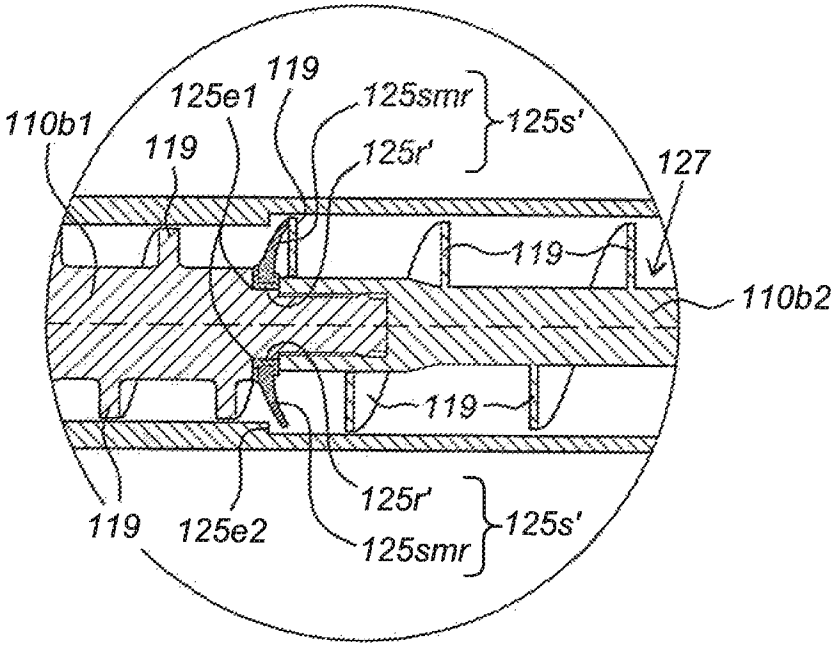
Figure 7A:
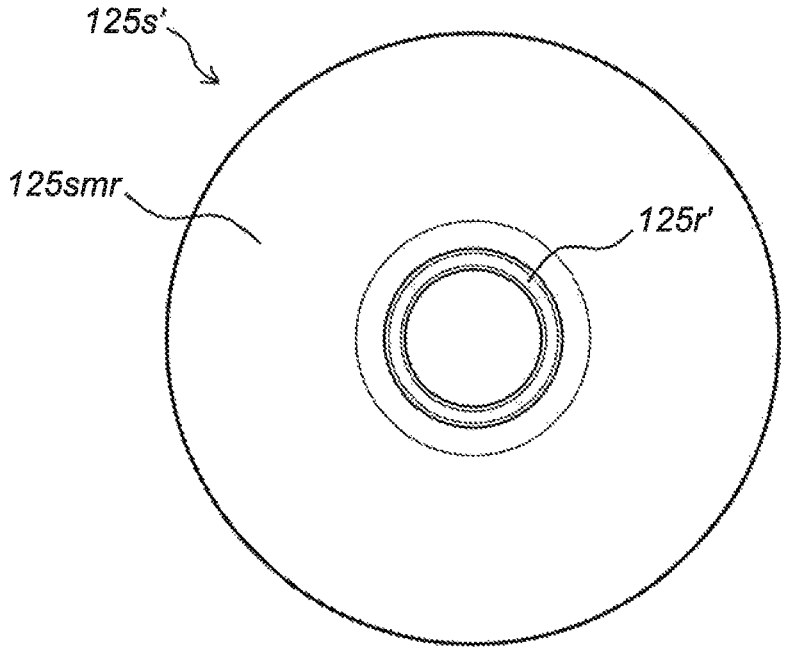
Figure 7B:
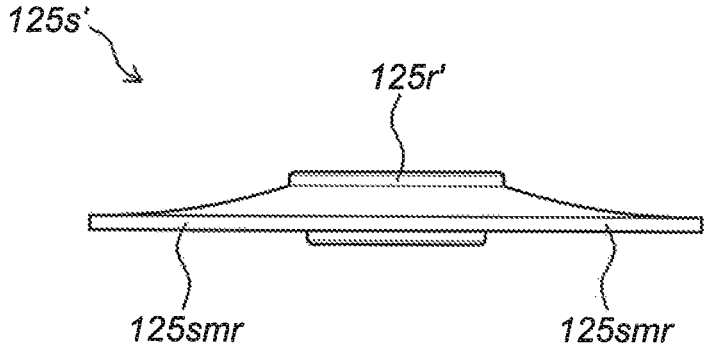

FIG. 2*a* shows a part of a cross-sectional view of the downhole tool of FIG. 1*a*, wherein the valve is open;

FIG. 2*b* shows a part of a cross-sectional view of the downhole tool of FIG. 1*a*, wherein the valve is closed;

FIG. 3*a* shows a sealing element when in a closed position in accordance with an embodiment of the invention;

FIG. 3*b* shows the sealing element of FIG. 3*a* when in an open position;

FIGS. 4*a*-4*d* show different variant of the sealing element in accordance with other embodiments of the invention;

FIG. 5 shows a downhole tool in accordance with another embodiment of the invention;

FIG. 6*a* shows a part of a cross-sectional view of the downhole tool of FIG. 5, wherein the valve is open;

FIG. 6*b* shows a part of a cross-sectional view of the downhole tool of FIG. 5, wherein the valve is closed, and FIG. 7 shows a sealing element in accordance with the downhole tool of FIG. 5.

DETAILED DESCRIPTION OF THE EMBODIMENTS

The invention provides for a downhole tool for collecting debris having a valve, which does hardly need any force to open, while it ensures a good sealing when the tool is removed from a petroleum well. This will be further explained in the detailed description, which follows.

FIG. 1*a* shows a downhole tool 100 in accordance with a first embodiment of the invention. The downhole tool 100 comprises a housing 120 with an opening 105 at the tip. In this embodiment the housing 120 forms a valve module 120 of the downhole tool 100, in series with a first collection module 130-1 and a second collection module 130-2, as illustrated. The first collection module 130-1 embodies a first collection chamber, and the second collection module 130-2 embodies a second collection chamber. From now on the collection modules 130-1, 130-2 will be referred to as "collection chambers". The second collection module 130-2 may comprise a filter section as in this embodiment. In operational use of the downhole tool 100 the second collection module 130-2 may be connected to a rotation motor (not shown), which on its turn may be connected to a downhole tractor (not shown). A downhole tractor is generally used for bringing the downhole tool to its desired place, but also for providing push-and-pull power downhole and for providing anchoring function for the downhole tool 100. The rotation motor may be an electric motor. There may also be provided a damper unit (not shown) between the electric motor and the downhole tool 100 in order to achieve an increased tool performance. In alternative embodiments of the downhole tool 100 there may be more collection modules than shown in FIG. 1, all modules being connected in series and in fluid communication with each other. For more implementation aspects of the downhole tool, including its function and operation, reference is made to the patent application publication with number WO03/036020A1.

FIG. 1*b* shows an enlarged view of the downhole tool of FIG. 1*a*. In this view the two collection chambers 130-1, 130-2 have been shortened for illustration purposes. This figure shows more clearly the tip of the tool. In the opening 105 there is provided an input screw 110*a*, which has a conical-shaped head 110*ah* for facilitating the collection of debris in the opening 105. It must be stressed that this input screw is just an example. Other types of input screws that look different may be used as well.

FIG. 1*c* shows an enlarged view of FIG. 1*b*, wherein further details are more clearly visible. The figure shows that inside the housing 120 there is a transport screw 110*b*, which in this embodiment comprises of two parts 110*b*1, 110*b*2 having different lead or pitch. Around the transport screw 110*b* there is an annular volume 127 as illustrated. The transport screw 110*b* and the input screw 110*a* together effectively form the rotatable shaft 110 with transport blades. Between said two parts 110*b*1, 110*b*2 of the transport screw 110*b* there is provided a valve 125 in accordance with the invention. The annular volume is here defined as the volume after the valve 125 when seen from the opening 105. The use of an input screw 110*a* and a transport screw 110*b* is just an embodiment of the "rotatable shaft with transport blades" as mentioned in the claims. By no means is the invention limited to the use of screws for inputting or transporting the debris. The pitch (or lead) of the second part 110*b*2 of the transport screw 110*b* is preferably larger than of the first part (as shown), because this prevents accumulation of debris right after the valve, which facilitates the pushing of the debris through the valve 125.

FIG. 2*a* shows a part of a cross-sectional view of the downhole tool of FIG. 1*a* wherein the valve is open. FIG. 2*b* shows a part of a cross-sectional view of the downhole tool of FIG. 1*a* wherein the valve is closed. These figures show further details of the downhole tool of the invention. The input screw 110*a* is mounted in the downhole tool 100 via bearings (not shown). Further is shown the transport blades 119, which in this embodiment extend into the collection chamber 130-1, but that is not essential, yet preferred. The radius of the rotatable shaft 110 and the transport blades 119 is typically smaller within the collection chambers 130-1, 130-2. Furthermore, in the second half part of the last collection chamber 130-2 there is typically no transport blades on the rotatable shaft in order to prevent that the downhole tool 110 stops collecting debris before the collection chamber 130-1, 130-2 is full.

FIG. 2*b* illustrates what is meant with the word "annular area" 121 as mentioned in the claims, which is defined as the area between the (rotatable) shaft of the transport screw 110*b*. The valve 125 of the invention comprises a seal member 125*s*, which covers the annular area 121 (at the location of the valve 125). The seal members 125*s* comprises a movable part 125*sm*, which in this embodiment takes a significant part of the area of the seal member 125*s*, such that it can move over a relative large distance. In this embodiment the valve 125 further comprises an edge 125*e*1 formed in the housing 120 (also referred to as valve module) for forming a contact surface 125*cs* for the movable part 125*sm* of the seal member 125*s* when in the closed position (FIG. 2*b*). The valve 125 further comprises a further edge 125*e*2 formed in the rotatable axis of the transport screw 110*b* for also forming the contact surface 125*cs* for the movable part 125*sm* of the seal member when in the closed position (FIG. 2*b*).

The downhole tool 100 as illustrated in FIGS. 2*a* and 2*b* functions as follows. When the input screw 110*a* is collecting debris in a petroleum well the debris (not shown) is transported by the first part 110*b*1 of the transport screw 110*b* towards the valve 125. There the debris will hit the movable part 125*sm* of the sealing element 125*s*. The sealing element 125*s* has been fixed to the transport screw 110*b* and rotates together with it. Therefore the movable part 125*sm* of the sealing element 125*s* will easily move outward. In this embodiment the movable part 125*sm* will conveniently rest in its open position on the threads 119 of the second part 110*b*2 of the transport screw 110*b*. This position is illustrated in FIG. 2*a*. The interesting effect in this position is that the movable part 125*sm* will not form any significant hindrance for the debris to be transported further into the collection chamber 130-1. This means that all forces will be used for rotating the screw and no significant force is used for opening the valve 125. The movable element 125*sm* will stay in the position of FIG. 2*a* until transport screw 110*b* stops rotating. As soon as that happens will the debris press the movable element 125*sm* back to the position of FIG. 2*b* against the contact surface 125*cs*, which seals of the annular area 121. The displacement of the movable part 125*sm* of the seal member 125*s* is illustrated by the two arrows d1, d2.

FIG. 3*a* shows a photo of a seal member 125*s* when in a closed position in accordance with an embodiment of the invention. FIG. 3*b* shows the sealing element 125*s* of FIG. 3*a* when in an open position. The seal member 125*s* in this embodiment is made of rubber, but other flexible materials are also possible. The number of variations of designing a seal member 125*s* is enormous. The example illustrated has a ring-shaped inner ring 125*r*. The hole in this ring has been intentionally designed non-round such that it will not easily rotate relative to the rotatable shaft when mounted. The movable part 125*sm* in this embodiment is effectively defined by cutting the seal member 125*s*. Such cutting may be conveniently done with a water-cutting technique. Furthermore, a mounting hole 126 has been formed, which is used to fix the seal member 125 to a transport blade of the transport screw with a small screw (not shown). Other ways to fix the seal member to the transport screw are also possible.

Figure 4A:
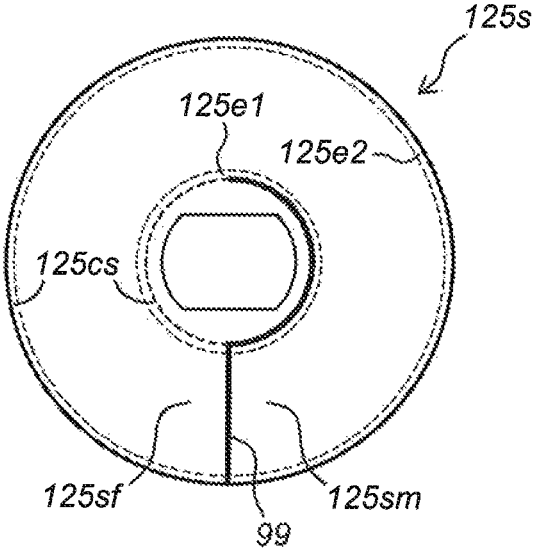

FIGS. 4*a*-4*d* show different variant of the sealing element in accordance with other embodiments of the invention. FIG. 4*a* shows the embodiment of FIGS. 3*a* and 3*b*. The figure illustrate how the piece of flexible material forming the seal member 125*s* may be cut in accordance with a cutting line 99. By cutting according to this cutting line 99 the movable part 125*sm* is defined. Simultaneously, an unmovable part 125*sf* of the seal member 125*s* is defined. The figure further illustrates the locations of the contact surfaces 125*cs* formed in the rotatable shaft and the housing/valve module (defined by the edge 125*e*1 and the further edge 125*e*2) with respect to the seal member 125*s* and the movable part 125*sm*. The embodiment illustrated in FIG. 4*a* provides for a movable element 125*sm* having a larger displacement in the open position. This embodiment fits best when the transport screw 110*b* has a lead being equal to its pitch (which is true for all single-start thread-forms).

Figure 4B:
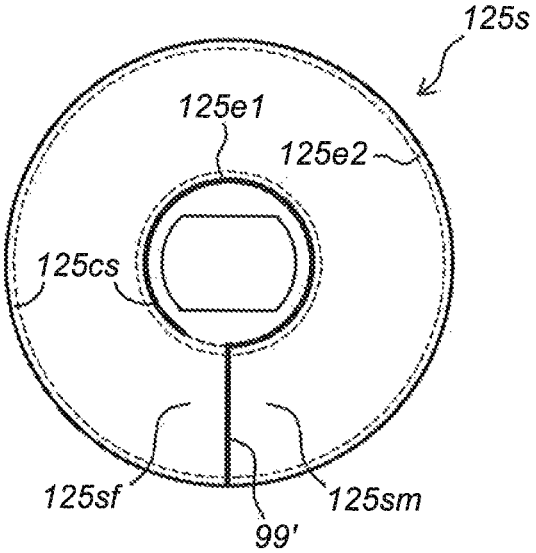

FIG. 4*b* shows an alternative embodiment. In this embodiment an alternative cutting line 99' is made which is longer in that it follows the circumference longer. In this way a movable part 125*sm* is made having a larger displacement in the open position, which allows more debris to be transported through the valve.

Figure 4C:
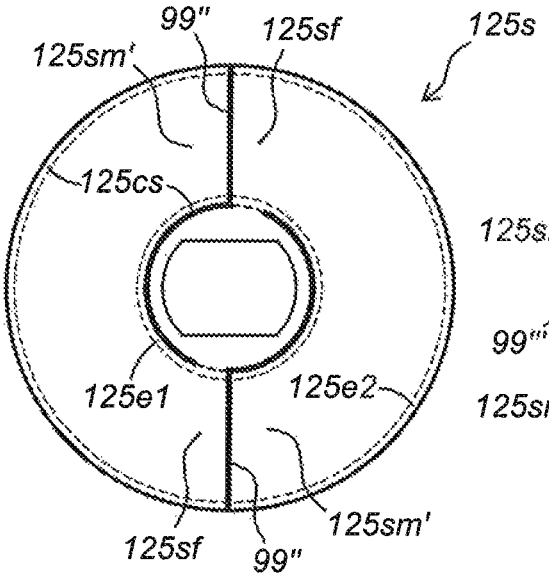

FIG. 4*c* shows yet an alternative embodiment. Instead of forming one large movable part a plurality (here two) of movable parts 125*sm'* is made by cutting in accordance with further alternative cut lines 99" as shown. This embodiment also allows for more debris to be transported through the valve than in the embodiment of FIG. 4*a*. Furthermore, this embodiment is very suitable to be used when the transport screw has double-started threadform, i.e. two threads intertwined with each other (but that does not need to be the case).

Figure 4D:
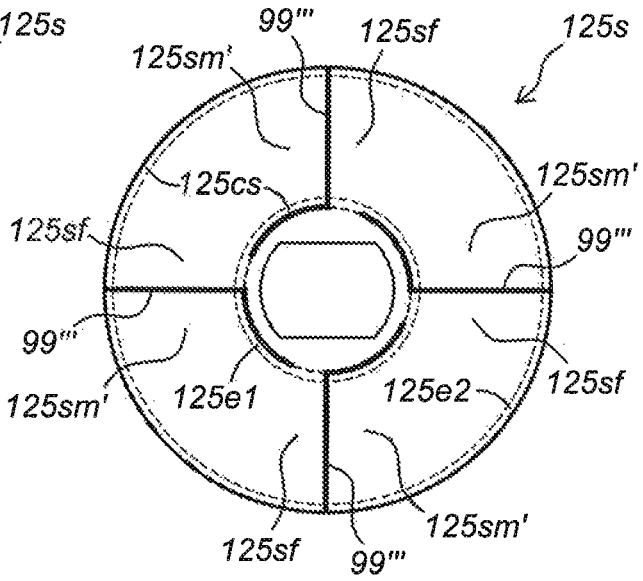

FIG. 4*d* shows yet a further alternative embodiment, wherein four movable parts 125*sm'* are formed by using further alternative cutting lines 99'". This embodiment is suitable to be used when the transport screw has a quadruple-started threadform (but that does not need to be the case).

FIG. 5 shows a downhole tool in accordance with another embodiment of the invention. This embodiment will be discussed in as far as it differs from the embodiment of FIG. 1. The main difference resides in the design of the valve as will be further explained with reference to the following drawings.

FIG. 6*a* shows a part of a cross-sectional view of the downhole tool of FIG. 5, wherein the valve is open. FIG. 6*b* shows a part of a cross-sectional view of the downhole tool of FIG. 5, wherein the valve is closed. These drawings will be only discussed in as far as they differ from FIGS. 2*a* and 2*b*. The main difference resides in the design of the seal member 125*s*' of the valve. The seal member 125*s*' comprises a ring-shaped inner mounting ring 125*r*' mounted around the rotatable shaft 110*b* such that it can rotate around the shaft 110*b*. The mounting ring 125' may be made from metal for example. Around the mounting ring 125*r*', here within a circumferential recess on the ring, there is provided a ring-shaped bendable disk 125*smr*. The ring-shaped bendable disk 125*smr* may be made from flexible material such as rubber, just like the seal member in accordance with FIGS. 1 to 4. FIGS. 6*a* and 6*b* illustrate that how the bendable disk 125*smr* may bend to open and close the valve respectively. The shape of the bendable disk 125*smr* has been further optimized to facilitate bending in the direction of the collection chamber 130-1 when debris is being collected. The most important difference with FIGS. 2*a* and 2*b* is that the disk 125*smr* is one piece, i.e. it has no cuts. Also important to note that the disk 125*smr* is sealing against both the mounting ring 125*r*' as well as the contact service 125*cs* of the housing (here the valve module 120) when the valve is closed (FIG. 6*b*).

FIG. 7 shows a sealing element in accordance with the downhole tool of FIG. 5. The figure shows the shape of the seal member 125*s*' in a bit more detail. The ring-shaped bendable disk 125*smr* may be mounted to the mounting ring 125*r*' by means of a moulding process for example. Such moulding process provides for a firm attachment between said parts 125*smr*, 125*r*'.

The downhole tool in accordance with FIGS. 5 and 6 operates as follows. When the valve is closed (FIG. 6*b*) the bendable disk 125*smr* is in grip with the housing 120, such that when the rotatable shaft 110 starts to rotate the seal member 125*r*' does not rotate. In other words, the seal member 125*r*' remains static with regards to the housing 120, while the seal member 125*r*' rotates relative to the rotatable shaft 110. The advantage of this is that the seal member 125*r*' does not wear out so fast. When the downhole tool collects debris (not shown) the debris will hit the seal member 125*r*' at a certain moment and bend the bendable disk 125*smr* thereof as illustrated in FIG. 6*a*. Herewith the valve 125 is opened and the debris will be pushed further into the collection chamber 130-1. When the downhole tool is finished with collecting debris the rotatable shaft 110 is stopped and the debris, which is already in the collection chamber 130-1 will push the bendable disk 125*smr* back in its closed position (FIG. 6*b*).

The description of the embodiments clearly illustrates that the valve in accordance with the invention is particularly simple in design and small in size. The valve covers the whole inner diameter of the collection chamber, while it has a very low building height. The low building height minimizes the distance between the input screws. A smaller distance between these screws leads to less energy that is required for pushing the debris through and beyond the valve. Moreover, a consequence of that is that more energy is available for filling the collection chamber. The downhole tool in accordance with the invention is thus very energy effective.

The valve in accordance with the invention is also very cost effective. This is a result of the construction, the manner the valve is mounted, the material choice, etc. Furthermore, the valve is also very robust and durable. Before each usage, a simple visual inspection will be required to see if the valve needs to be replaced.

The thickness of the seal member may be chosen dependent on the diameter of the downhole tool. The larger the required diameter of the seal member the larger the required thickness in order to avoid valve distortion. In any case, the design of the downhole tool may remain the same independent of the size.

The material of the seal member may be adapted to the well conditions under which the downhole tool has to be operated. High temperatures or environments with high concentrations of gasses may influence some rubber types. Nevertheless, this problem may be solved by simply changing the material to another material (i.e. replacing the seal member with another seal member), which is capable of handling these different conditions.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage.

The invention claimed is:

1. A downhole tool (100) for collecting debris in a petroleum well, the downhole tool (100) comprising:

a housing (120) connected with a collection chamber (130-1, 130-2) for receiving debris, the housing (120) having an opening (105) for collecting the debris from the petroleum well, the opening (105) being in fluid communication with the collection chamber (130-1, 130-2) through the housing (120);

a rotatable shaft (110*b*) with transport blades (119) arranged within the housing (120) and extending from the opening (105) to the collection chamber (130-1, 130-2), the rotatable shaft (110*b*) being configured for transporting the debris from the opening (105) to the collection chamber (130-1, 130-2) in operational use;

an annular area (121) defined between the rotatable shaft (110*b*) and an inner wall of the housing (120), and a valve (125) configured for keeping the debris in the collection chamber (130-1, 130-2), characterised in that the valve (125) is located within the housing (120) between the opening (105) and the collection chamber (130-1, 130-2), wherein the valve (125) further comprises a seal member (125*s*) with a movable part (125*sm*) being mounted in the annular area (121) and around the rotatable shaft (110*b*), wherein the valve (125) is opened when the movable part (125*sm*) moves in direction of the collection chamber (130-1, 130-2), wherein the valve (125) is configured such that the movable part (125*sm*) of the seal member (125*s*) is only movable in the direction towards the collection chamber (130-1, 130-2) when closed, the valve comprises a contact surface (125*cs*) for the movable part (125*sm*) to seal against when closed;

the inner wall of the housing (120) comprises a further edge (125*e*2) for forming the contact surface (125*cs*);

wherein the seal member (125*s*) comprises a ring-shaped inner mounting ring (125*r*) for being mounted to the rotatable shaft (110*b*), wherein the movable part (125*sm*) is connected with the ring-shaped inner mounting ring (125*r*).

2. The downhole tool (100) as claimed in claim 1, wherein the seal member (125*s*) is configured for being substantially static either with respect to the rotatable shaft (110*b*) or with respect to the housing (120) when valve (125) is closed while the rotatable shaft (110*b*) is rotating in operational use of the downhole tool (100).

3. The downhole tool (100) as claimed in claim 2, wherein the seal member (125*s*) is mounted around and fixed to the rotatable shaft (110*b*) such that it rotates together with the rotatable shaft (110*b*) and relative to the housing (120) in operational use of the downhole tool (100).

4. The downhole tool (100) as claimed in claim 2, wherein the seal member (125*s*) is mounted around the rotatable shaft (110*b*) such that it may rotate relative to the rotatable shaft (110*b*) while being substantially static with respect to the housing (120) even when the rotatable shaft (110*b*) is rotating in operational use of the downhole tool (100).

5. The downhole tool (100) as claimed in claim 1, wherein the rotatable shaft (110*b*) comprises an edge (125*e*1) for forming the contact surface (125*cs*).

6. The downhole tool (100) as claimed in claim 1, wherein the movable part of the sealing member is configured as a pivotably mounted or bendable curved flap (125*sm*), which extends within the annular area (121) along at least part of the circumference of the seal member (125*s*).

7. The downhole tool (100) as claimed in claim 1, wherein the movable part of the sealing member is configured as a ring-shaped bendable disk (125*smr*) substantially covering the annular area (121).

8. The downhole tool (100) as claimed in claim 1, wherein the seal member (125*s*, 125*s*') has been made from flexible material, such as rubber, plastic, or other elastic or woven materials.

9. The downhole tool (100) as claimed in claim 1, wherein the seal member (125*s*) comprises a plurality of further movable parts (125*sm*') similar to the movable part (125*sm*), wherein said plurality of further movable parts (125*sm*') is distributed along a circumference of the seal member (125*s*).

10. The downhole tool (100) as claimed in claim 1, wherein the valve (125) further comprises a further housing comprising a further seal member similar to the housing (120) and the seal member (125*s*) and being displaced from the seal member (125*s*) and being mounted in the annular area (121) and around the rotatable shaft (110*b*) within the further housing.

11. The downhole tool (100) as claimed in claim 1, further comprising a plurality of collection modules (130-1, 130-2) for collecting debris.

* * * * *